United States Patent [19]

Kinashi

[11] 4,314,755

[45] Feb. 9, 1982

[54] BIAS VOLTAGE CONTROLLED DEVELOPING SYSTEM IN AN ELECTROPHOTOGRAPHIC COPYING MACHINE

[75] Inventor: Hiroshi Kinashi, Uji, Japan

[73] Assignee: Sharp Kabushiki Kaisha, Osaka, Japan

[21] Appl. No.: 89,235

[22] Filed: Oct. 29, 1979

[30] Foreign Application Priority Data

Oct. 31, 1978 [JP] Japan ..... 53-134976

[51] Int. Cl.[3] ..... G03G 15/00

[52] U.S. Cl. ..... 355/14 D; 118/647; 355/3 DD

[58] Field of Search ..... 355/14 D, 3 DD, 10; 118/647, 648, 650, 651, 662, 656–658, 665, 688, 624

[56] References Cited

U.S. PATENT DOCUMENTS

T956,001 3/1977 Kasper et al. ..... 118/657 X
2,902,974 9/1959 Greaves ..... 118/656
3,814,516 6/1974 Whited ..... 118/647 X
3,816,756 6/1974 Bresnick ..... 355/14 D

*Primary Examiner*—Richard L. Moses
*Attorney, Agent, or Firm*—Birch, Stewart, Kolasch and Birch

[57] ABSTRACT

An electrophotographic copying machine is disclosed comprising an image formation section for forming an electrostatic latent image on a photosensitive drum, and a magnet brush developing unit for developing the electrostatic latent image through the use of toner. A bias voltage is applied between the photosensitive drum and the magnet brush developing unit. A humidity sensor is disposed in the electrophotographic copying machine to develop an output signal indicative of the humidity in the electrophotographic copying machine. A bias voltage control circuit is associated with the humidity sensor for selectively determining the bias voltage at a higher value when the humidity exceeds a preselected threshold value. When the humidity is below the preselected threshold value, the bias voltage is held at a lower value.

10 Claims, 4 Drawing Figures

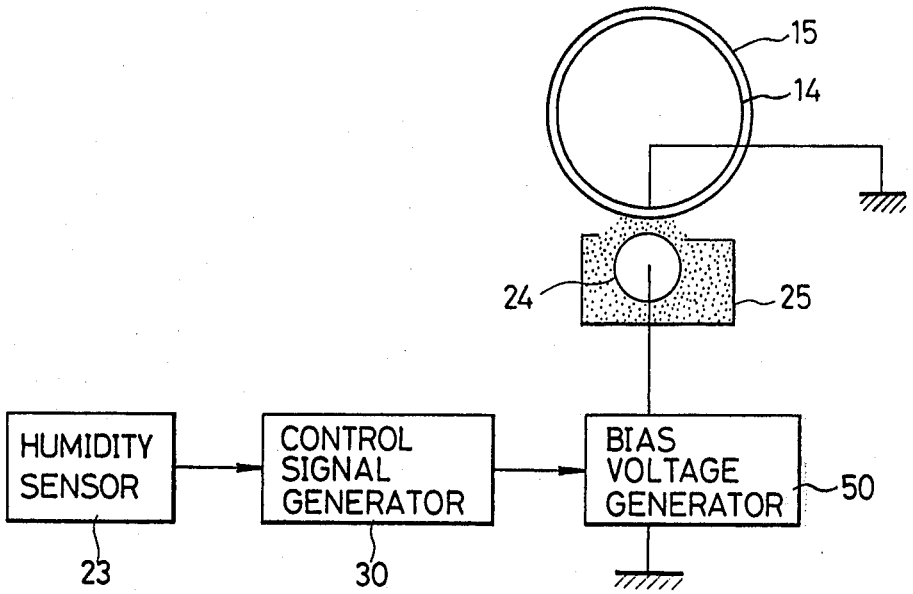
FIG. 2
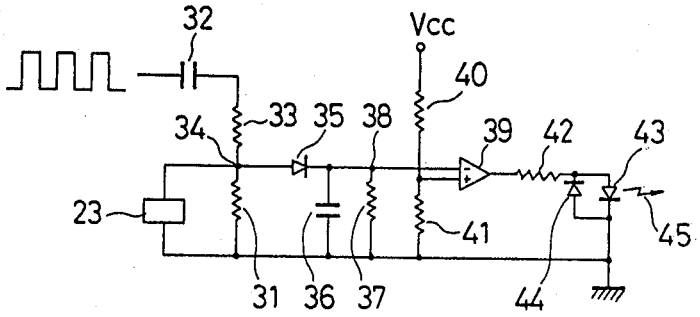
FIG. 3 (CONTROL SIGNAL GENERATOR -30- )

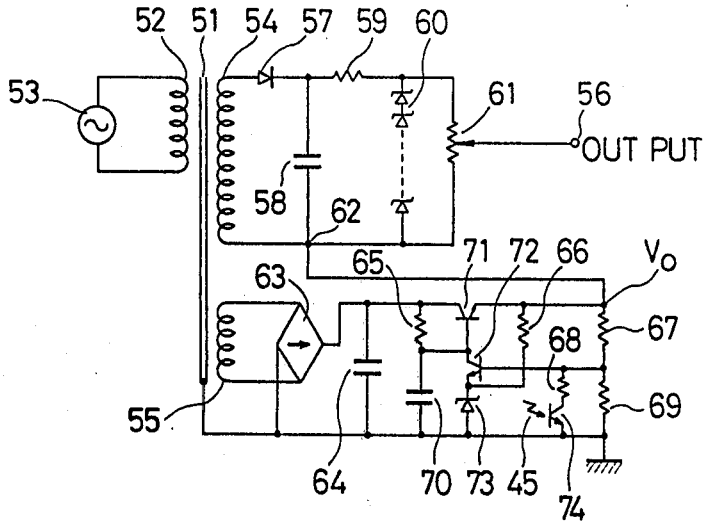
FIG. 4 (BIAS VOLTAGE GENERATOR -50-)

BIAS VOLTAGE CONTROLLED DEVELOPING SYSTEM IN AN ELECTROPHOTOGRAPHIC COPYING MACHINE

BACKGROUND AND SUMMARY OF THE INVENTION

The present invention relates to a developing system for developing an electrostatic latent image in an electrophotographic copying machine and, more particularly, to a bias voltage control system in the developing system.

A bias voltage developing system has been developed, wherein a bias voltage is applied between a photosensitive drum and a magnet brush developing device for ensuring a clean developing. The bias voltage developing system is very effective for obtaining a clean background even though residual electric charges are held on the photosensitive drum at the background section. However, a stable developing operation was not ensured even in the bias voltage developing system when subjected to an extraordinarily high temperature, humidity condition or an extraordinarily low temperature, or humidity condition.

Under the high humidity condition, leakage current problems will occur in the corona charging device and in the photosensitive drum surface. And, under the low humidity condition, the corona charging current will increase and the resistance value of the photosensitive material will increase. These factors will influence the level of the electrostatic latent image formed on the photosensitive drum. Therefore, if the bias voltage has a fixed value, clean developing is not ensured when the humidity varies.

Accordingly, an object of the present invention is to provide a novel developing system for ensuring clean developing in an electrophotographic copying machine.

Another object of the present invention is to provide a magnet brush developing system, which ensures clean developing without regard to variations of the humidity.

Still another object of the present invention is to provide a control system for varying a bias voltage applied between a photosensitive drum and a magnet brush developing device in response to variations of the humidity.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a humidity sensor is disposed near a photosensitive drum in an electrophotographic copying machine for detecting the humidity in the copying machine, especially, the humidity of a photosensitive material. A voltage control circuit is associated with the humidity sensor for varying a bias voltage applied between the photosensitive drum and a developing device in accordance with an output signal derived from the humidity sensor.

In a preferred form, when the humidity sensor indicates that the humidity is above a preselected value, for example, 75%, the bias voltage is selected at a higher value, for example, 120 V. If the humidity sensor indicates that the humidity is below the preselected value, the bias voltage is selected at a lower value, for example, 60 V.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 2 is a block diagram of an embodiment of the developing system of the present invention;

FIG. 3 is a circuit diagram of a control signal generator included in the developing system of FIG. 2; and FIG. 4 is a circuit diagram of a bias voltage generator included in the developing system of FIG. 2.

DESCRIPTION OF THE PREFERRED EMBODIMENTS

Figure 1:
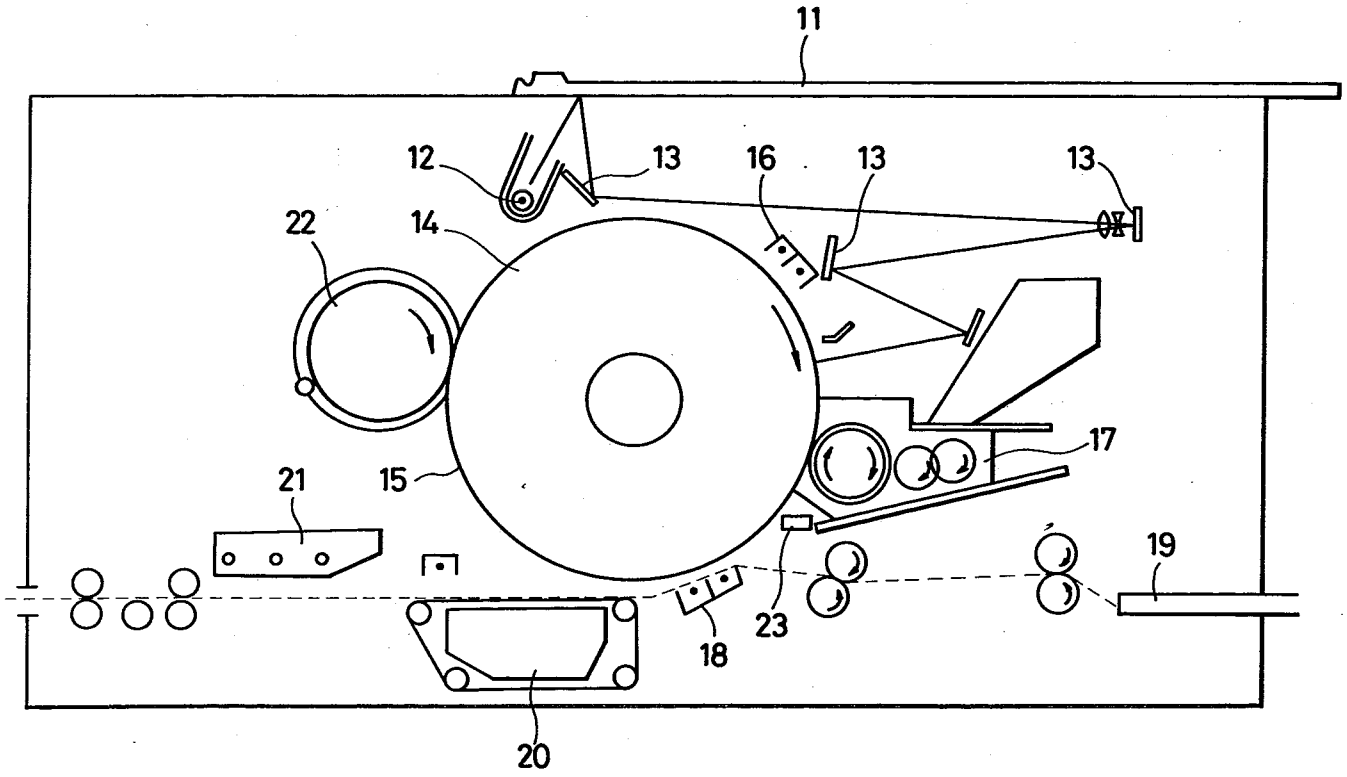
FIG. 1 is a schematic sectional view of an electrophotographic copying machine employing a developing system of the present invention.

Referring now in detail to the drawings, and to facilitate a more complete understanding of the present invention, a general construction of an electrophotographic copying machine will be first described with reference to FIG. 1.

The electrophotographic copying machine mainly comprises a reciprocating original carrier 11 for supporting an original disposed thereon, a light source 12 for irradiating the original disposed on the reciprocating original carrier 11, and an optical system 13 for forming an image from the original onto a photosensitive sheet 15 mounted around a drum 14.

A corona charging unit 16 is disposed near the drum 14 for uniformly charging the photosensitive sheet 15. An electrostatic latent image is formed on the thus uniformly charged photosensitive sheet 15 through the use of the optical system 13. A developing unit 17 is disposed to develop the electrostatic latent image through the use of a toner. The thus formed developed image on the photosensitive sheet 15 is transcribed onto a copy paper supplied from a copy paper supplier 19 at a transcription section including a transcription corona charging unit 18. The copy paper carrying the transcribed toner image thereon is separated from the drum 14 through the use of a separator unit 20 and supplied to a fixing section 21. The fixing section 21 includes a fixing heater for fixing the transcribed toner image carried on the copy paper. A cleaning device 22 is disposed to remove the excess toner carried on the photosensitive sheet 15.

The drum 14 can be made of aluminum, and the photosensitive sheet 15 can be made of an organic photosensitive material, Se, or ZnO. Alternatively, the photosensitive drum can be a three-layered construction, comprising an aluminum drum, a CdS photosensitive layer, and a transparent insulator layer formed on the CdS layer. In this case, first and second charging units are required for forming the electrostatic latent image.

The copying machine of the present invention further comprises a humidity sensor 23 disposed near the photosensitive drum for detecting the humidity of the photosensitive sheet 15. The humidity sensor 23 can be one of several well-known devices. A preferred humidity sensor 23 is a ceramic humidity sensor which shows a decreasing resistance curve as the humidity increases, for example, "HUMICERAM" manufactured by Matsushita Electric Industrial Co., Ltd.

FIG. 2 schematically shows an embodiment of the developing system of the present invention. Like elements corresponding to those of FIG. 1 are indicated by like numerals.

The aluminum drum 14 is maintained at a ground potential. The developing unit 17 comprises a magnet brush developing device 24 and a developer reservoir 25 for containing a toner therein. A bias voltage is applied between the drum 14 and the magnet brush developing device 24 for ensuring a clean developing.

More specifically, when the electrostatic latent image has a positive polarity and the toner has a negative polarity, a positive bias voltage is applied to the magnet brush developing device 24 to obtain a clean background.

A bias voltage generator 50 is connected to the magnet brush developing device 24 in order to supply a selected bias voltage to the magnet brush developing device 24. The humidity sensor 23 is associated with a control signal generator 30, which develops a control signal in response to variations of an output signal of the humidity sensor 23. The thus developed control signal is applied to the bias voltage generator 50 for varying the bias voltage applied to the magnet brush developing device 24.

FIG. 3 shows a detailed construction of the control signal generator 30.

The humidity sensor 23, which shows the decreasing resistance characteristics as the humidity increases, is connected to a resistor 31 in a parallel fashion. The thus formed parallel circuit is power supplied by an alternating pulse voltage through a capacitor 32 and a resistor 33. The node 34 provides an alternating voltage signal indicative of the resistance value of the humidity sensor 23. More specifically, when the humidity increases, the voltage level at the node 34 decreases because the resistance value of the humidity sensor 23 decreases.

The thus obtained alternating voltage signal is applied to a rectifying circuit comprising a diode 35, capacitor 36 and a resistor 37 for providing a DC detection output $V_d$ at a node 38. The DC detection output $V_d$ is applied to a negative input terminal of an operation amplifier 39. The positive input terminal of the operation amplifier 39 is connected to receive a reference voltage signal $V_s$ determined by resistors 40 and 41. The level of the reference voltage signal $V_s$ is selected at a level identical with the level of the DC detection output $V_d$ when the humidity is 75%.

Accordingly, when the humidity is above 75%, the DC detection output $V_d$ is smaller than the reference voltage signal $V_s$. Therefore, the output signal of the operation amplifier 39 bears the positive value. Thus, an electric current flows through a resistor 42 and a light emitting diode 43 for emitting a signal light 45. Contrarily, when the humidity is below 75%, the DC detection output $V_d$ is greater than the reference voltage signal $V_s$. The output signal of the operation amplifier 39 bears the negative value and, therefore, an electric current flows through the resistor 42 and a diode 44. Thus, the signal light 45 is not developed.

The thus obtained signal light 45 is applied to the bias voltage generator 50 for varying the bias voltage level. FIG. 4 shows a detailed construction of the bias voltage generator 50.

The bias voltage generator 50 mainly comprises a transformer 51 including a primary winding 52 connected to an alternating voltage source 53, a secondary winding 54 for output purposes, and an auxiliary winding 55 for varying the output voltage level derived from an output terminal 56 which is connected to the magnet brush developing device 24.

The secondary winding 54 is connected to a rectifying circuit comprising a diode 57, a capacitor 58 and a resistor 59. A series circuit 60 of Zener diodes is connected to a variable resistor 61 in a parallel fashion to stably develop an output voltage at the output terminal 56. The output voltage level is fixed to 40 V with respect to a node 62 which is connected to an output stage of the circuit connected to the auxiliary winding 55.

The auxiliary winding 55 is connected to a constant voltage circuit via a rectifying circuit 63 and a capacitor 64. The constant voltage circuit comprises resistors 65, 66, 67, 68 and 69, a capacitor 70, transistors 71 and 72, a Zener diode 73, and a phototransistor 74 responsive to the signal light 45.

Now assume that the resistor 67 has the resistance value $R_2$, and the total resistance of the resistors 68 and 69 and the phototransistor 74 is $R_1$.

An output voltage $V_0$ of the output stage of the constant voltage circuit is divided by $R_1$ and $R_2$, and the divided voltage is applied to the base electrode of the transistor 72. The emitter electrode of the transistor 72 is connected to receive a reference voltage $V_{ZD}$ determined by the Zener diode 73. When the divided voltage becomes greater than the reference voltage $V_{ZD}$, the internal resistance of the transistor 71 increases, and when the divided voltage becomes smaller than the reference voltage $V_{ZD}$, the internal resistance of the transistor 71 decreases, whereby the output voltage $V_0$ is fixed to satisfy the following relationship.

$$V_0 \approx \left(1 + \frac{R_2}{R_1}\right) \cdot V_{ZD}$$

Under these conditions, when the signal light 45 is applied to the phototransistor 74, the resistance value $R_1$ decreases and, therefore, the output voltage $V_0$ is held at a first level $V_{01}$ of the higher value. Contrarily, when the signal light 45 is not applied to the phototransistor 74, the output voltage $V_0$ is held at a second level $V_{02}$ of the lower value. That is, when the humidity exceeds the preselected value, 75%, the output voltage $V_0$ is held at the first level $V_{01}$ and, therefore, the output voltage from the variable resistor 61 connected to the secondary winding 54 increases.

In a preferred form, the first level $V_{01}$ is selected at 80 V, and the second level $V_{02}$ is selected at 20 V. More specifically, the bias voltage applied to the magnet brush developing device 24 is 120 V when the humidity is above 75%, and the bias voltage is 60 V when the humidity is below 75%.

The photosensitive drum has the three-layered construction comprising an aluminum drum, a CdS photosensitive layer, and a transparent insulator layer formed on the photosensitive layer. The electrostatic latent image is formed on the photosensitive drum through the use of a first charging of DC+7.0 KV and a second charging of AC 6.5 KV. The electrostatic latent image is developed under the bias voltage of 60 V in the condition of 25° C., 60% humidity. The electrostatic latent image is also developed under a different condition of bias voltage 120 V, temperature 30° C., and humidity 85%. The thus obtained two copies show the substantially same quality.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A copying machine comprising:

a photosensitive drum of a multi-layer construction;

said drum including a photosensitive layer and an insulator layer formed on the photosensitive layer;

image formation means for forming an electrostatic latent image on said photosensitive drum;

developing system means for developing said electrostatic latent image formed on said photosensitive drum;

transcription means for transcribing the developed image formed on said photosensitive drum onto a copy paper; and humidity sensor means disposed in said copying machine for detecting the humidity therein and for developing an output signal indicative thereof, said developing system comprising, developing device means for applying a toner to said electrostatic latent image formed on said photosensitive drum, bias voltage application means for applying a bias voltage between said developing device means and said photosensitive drum; and control means for varying the level of said bias voltage in response to said output signal derived from said humidity sensor means, said control means increasing said bias voltage when the humidity sensed by said humidity sensor means increases and decreasing said bias voltage when the humidity sensed by the humidity sensor means decreases.

2. The copying machine of claim 1, wherein said developing device comprises a magnet brush developing device.

3. The copying machine of claim 1 or 2, wherein said humidity sensor means is disposed near said developing device means.

4. A developing system for developing an electrostatic latent image formed on a photosensitive material in a copying machine, said photosensitive material having an insulator layer formed thereover, said developing system comprising:

a developing device for applying a toner to said electrostatic latent image formed on said photosensitive material;

bias voltage application means for applying a bias voltage between said developing device and said photosensitive material;

humidity sensor means for sensing the humidity in said copying machine;

control signal generator means for developing a control signal in accordance with the humidity sensed by said humidity sensor means; and bias voltage variation means responsive to said control signal for varying the level of said bias voltage in response thereto, said bias voltage variation means increasing the bias voltage when the humidity sensed by said humidity sensor means increases above a particular value and decreasing the bias voltage when the humidity sensed by said humidity sensor means decreases below said particular value.

5. A developing system for developing an electrostatic latent image formed on a photosensitive material in a copying machine, said developing system comprising:

a developing device for applying a toner to said electrostatic latent image formed on said photosensitive material;

bias voltage application means for applying a bias voltage between said developing device and said photosensitive material;

humidity sensor means for sensing the humidity in said copying machine;

control signal generator means for developing a control signal in accordance with the humidity sensed by said humidity sensor means;

bias voltage variation means resposive to said control signal for varying the level of said bias voltage applied by said bias voltage application means, said bias voltage variation means including, a constant voltage circuit; and a phototransistor disposed in said constant voltage circuit for varying the constant voltage derived from said constant voltage circuit; and said control signal generator including, a determination means for determining whether the humidity sensed by said humidity sensor means is above a preselected value;

a light emitting diode for emitting a signal light when an affirmative answer is obtained by said determination means, said signal light being applied to said phototransistor for increasing the level of said bias voltage when the humidity is above said preselected value.

6. The developing system of claim 5, wherein said developing device comprises a magnet brush developing device.

7. The developing system of claim 6, wherein said preselected value is approximately 75%.

8. The developing system of claim 7, wherein said bias voltage is selected to be approximately 120 V when the humidity is above approximately 75%.

9. The developing system of claim 7, wherein said bias voltage is selected to be approximately 60 V when the humidity is below approximately 75%.

10. The developing system of claim 5, wherein said determination means comprises an operational amplifier.

* * * * *